US008978963B2

(12) United States Patent
Kastanek et al.

(10) Patent No.: US 8,978,963 B2
(45) Date of Patent: Mar. 17, 2015

(54) CARTON WITH HANDLE AND DISPENSER

(75) Inventors: Raymond S. Kastanek, Longmont, CO (US); Mark Baldino, Marietta, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 262 days.

(21) Appl. No.: 13/402,080

(22) Filed: Feb. 22, 2012

(65) Prior Publication Data

US 2012/0211552 A1 Aug. 23, 2012

Related U.S. Application Data

(60) Provisional application No. 61/463,847, filed on Feb. 23, 2011.

(51) Int. Cl.

| | |
|---|---|
| ***B65D 5/54*** | (2006.01) |
| ***B65B 69/00*** | (2006.01) |
| ***B31B 49/02*** | (2006.01) |

(Continued)

(52) U.S. Cl.

CPC ..... *B65D 71/36* (2013.01); *B65D 81/18* (2013.01); *B65D 5/40* (2013.01); *B65D 2571/00141* (2013.01); *B65D 2571/00469* (2013.01); *B65D 2571/00524* (2013.01); *B65D 2571/00549* (2013.01); *B65D 2571/00574* (2013.01);

(Continued)

(58) Field of Classification Search

CPC ..... B65D 2571/00141; B65D 2571/0066; B65D 2571/00728; B65D 71/36; B65D 2571/00574; B65D 2571/00469; B65D 2571/00512

USPC ..... 229/243; 493/121

See application file for complete search history.

(56) References Cited

U.S. PATENT DOCUMENTS

| | | | |
|---|---|---|---|
| 1,253,193 | A | 1/1918 | Hill |
| 2,594,376 | A | 4/1952 | Arneson |

(Continued)

FOREIGN PATENT DOCUMENTS

| | | |
|---|---|---|
| CA | 2160145 | 9/1995 |
| DE | 8514718.4 | 6/1985 |

(Continued)

OTHER PUBLICATIONS

International Search Report and Written Opinion for PCT/US2013/030321 dated Jun. 12, 2013.

(Continued)

*Primary Examiner* — Christopher Demeree

(74) *Attorney, Agent, or Firm* — Womble Carlyle Sandridge & Rice, LLP

(57) ABSTRACT

A carton for containing a plurality of articles. The carton comprises a top panel, a first side panel, a second side panel, and a bottom panel. End flaps can be respectively foldably connected to respective panels and at least partially overlapped with respect to one another to thereby at least partially form a closed end of the carton. A dispenser panel can be at least partially defined by a dispenser tear line extending in at least the top panel and at least one of the end flaps. An opening section can be at least partially defined by the dispenser tear line and can be foldably connected to one of the first side panel and the second side panel. The dispenser panel is at least partially removable from the carton to create a dispenser opening, and the opening section is positionable relative the first side panel to expand the dispenser opening.

56 Claims, 6 Drawing Sheets

(51) Int. Cl.

| | |
|---|---|
| ***B65D 5/42*** | (2006.01) |
| ***B65D 5/46*** | (2006.01) |
| ***B65D 71/36*** | (2006.01) |
| ***B65D 81/18*** | (2006.01) |
| ***B65D 5/40*** | (2006.01) |

(52) U.S. Cl.

CPC ..... *B65D2571/0066* (2013.01); *B65D 2571/00728* (2013.01)

USPC ..... 229/117.13; 229/243; 229/101; 493/162

(56) References Cited

U.S. PATENT DOCUMENTS

| | | | | |
|---|---|---|---|---|
| 2,810,506 | A | 10/1957 | Kessler | |
| 2,868,433 | A | 1/1959 | Anderson, Jr. | |
| 2,955,739 | A | 10/1960 | Collura | |
| 3,112,856 | A | 12/1963 | MacIntosh et al. | |
| 3,127,720 | A | 4/1964 | Gentry et al. | |
| 3,309,005 | A | 3/1967 | Pilger | |
| 3,886,901 | A | 6/1975 | Zeitter | |
| 4,036,423 | A | 7/1977 | Gordon | |
| 4,111,306 | A | 9/1978 | Roccaforte | |
| 4,216,861 | A | 8/1980 | Oliff | |
| 4,318,474 | A | 3/1982 | Hasegawa | |
| 4,328,923 | A | 5/1982 | Graser | |
| 4,329,923 | A | 5/1982 | Iida | |
| 4,364,509 | A | 12/1982 | Holley et al. | |
| 4,375,258 | A | 3/1983 | Crayne et al. | |
| 4,378,905 | A | 4/1983 | Roccaforte | |
| 4,424,901 | A | 1/1984 | Lanier | |
| 4,498,619 | A | 2/1985 | Roccaforte | |
| 4,546,914 | A | 10/1985 | Roccaforte | |
| 4,582,199 | A | 4/1986 | Schuster | |
| 4,588,084 | A | 5/1986 | Holley | |
| 4,747,487 | A | 5/1988 | Wood | |
| 5,020,337 | A | 6/1991 | Krieg | |
| 5,094,359 | A | 3/1992 | DeMars et al. | |
| 5,197,598 | A | 3/1993 | Stout et al. | |
| 5,246,112 | A | 9/1993 | Stout et al. | |
| 5,284,294 | A | 2/1994 | Floyd | |
| 5,292,058 | A | 3/1994 | Zoss et al. | |
| 5,297,725 | A | 3/1994 | Sutherland | |
| 5,303,863 | A | 4/1994 | Arasim | |
| 5,307,986 | A | 5/1994 | Schuster | |
| 5,333,734 | A | 8/1994 | Stout et al. | |
| 5,427,241 | A | 6/1995 | Sutherland | |
| 5,495,727 | A | 3/1996 | Strong et al. | |
| 5,551,556 | A | 9/1996 | Sutherland | |
| 5,582,343 | A | 12/1996 | Dalvey | |
| 5,593,027 | A | 1/1997 | Sutherland | |
| 5,595,292 | A | 1/1997 | Bates | |
| 5,639,017 | A | 6/1997 | Fogle | |
| 5,699,957 | A | 12/1997 | Blin et al. | |
| 5,704,470 | A | 1/1998 | Sutherland | |
| 5,738,273 | A | 4/1998 | Auclair | |
| 5,794,778 | A | 8/1998 | Harris | |
| 5,796,778 | A | 8/1998 | Kurker | |
| 5,826,782 | A | 10/1998 | Stout | |
| 5,873,515 | A | 2/1999 | Dunn et al. | |
| 5,915,546 | A | 6/1999 | Harrelson | |
| 5,992,733 | A | 11/1999 | Gomes | |
| 6,065,590 | A | 5/2000 | Spivey | |
| 6,105,853 | A | 8/2000 | Lamare | |
| 6,105,854 | A | 8/2000 | Spivey et al. | |
| 6,131,803 | A | 10/2000 | Oliff et al. | |
| 6,164,526 | A | 12/2000 | Dalvey | |
| 6,170,741 | B1 | 1/2001 | Skolik et al. | |
| 6,227,367 | B1 | 5/2001 | Harrelson et al. | |
| 6,523,739 | B2 | 2/2003 | Heeley et al. | |
| 6,631,803 | B2 | 10/2003 | Rhodes et al. | |
| 6,758,337 | B2 | 7/2004 | Chargueraud et al. | |
| 6,926,193 | B2 | 8/2005 | Smalley | |
| 7,427,010 | B2 | 9/2008 | Sutherland | |
| 7,748,603 | B2 | 7/2010 | Fogle et al. | |
| 7,806,314 | B2 | 10/2010 | Sutherland | |
| 8,191,761 | B2 * | 6/2012 | Brand | 229/117.12 |
| 2003/0213263 | A1 | 11/2003 | Woog | |
| 2004/0238611 | A1 | 12/2004 | Sutherland | |
| 2006/0169755 | A1 | 8/2006 | Spivey, Sr. | |
| 2006/0273143 | A1 | 12/2006 | Finch | |
| 2007/0051781 | A1 | 3/2007 | Holley, Jr. | |
| 2007/0164091 | A1 | 7/2007 | Fogle et al. | |
| 2007/0181658 | A1 | 8/2007 | Sutherland | |
| 2007/0284424 | A1 * | 12/2007 | Holley | 229/101 |
| 2008/0073420 | A1 * | 3/2008 | Walling et al. | 229/243 |
| 2010/0044420 | A1 | 2/2010 | Brand | |

FOREIGN PATENT DOCUMENTS

| | | | |
|---|---|---|---|
| DE | 202004018 649 | | 4/2005 |
| JP | 2007 055630 | A | 3/2007 |
| JP | 2008-013200 | A | 1/2008 |
| WO | WO2005/080218 | | 9/2005 |
| WO | WO 2007/089282 | | 8/2007 |

OTHER PUBLICATIONS

ISR/WO for related PCT application No. PCT/US2012/026050 mailed Sep. 21, 2012.

Supplementary European Search Report for EP 12 74 9996 dated Aug. 8, 2014.

* cited by examiner

CARTON WITH HANDLE AND DISPENSER

CROSS-REFERENCE TO RELATED APPLICATIONS

This application claims the benefit of U.S. Provisional Patent Application No. 61/463,847, filed Feb. 23, 2011.

INCORPORATION BY REFERENCE

The disclosure of U.S. Provisional Patent Application No. 61/463,847, which was filed on Feb. 23, 2011, and U.S. Pat. No. 7,806,314, which was issued on Oct. 5, 2010, are hereby incorporated by reference for all purposes as if presented herein in their entirety.

BACKGROUND OF THE DISCLOSURE

The present disclosure is generally related to a carton for holding containers, and more particularly, to a carton having a handle and a dispenser.

SUMMARY OF THE DISCLOSURE

In one aspect, the disclosure is generally directed to a carton for containing a plurality of articles. The carton comprises a plurality of panels that extend at least partially around an interior of the carton. The plurality of panels comprises a top panel, a first side panel, a second side panel, and a bottom panel. End flaps can be respectively foldably connected to respective panels of the plurality of panels. The end flaps are at least partially overlapped with respect to one another and thereby at least partially form a closed end of the carton. A dispenser comprises a dispenser panel and an opening section. The dispenser panel can be at least partially defined by a dispenser tear line extending in at least the top panel and at least one of the end flaps. The opening section can be at least partially defined by the dispenser tear line and can be foldably connected to one of the first side panel and the second side panel. The dispenser panel is at least partially removable from the carton to create a dispenser opening, and the opening section is positionable relative the first side panel to expand the dispenser opening.

In another aspect, the disclosure is generally directed to a blank for forming a carton. The blank comprises a plurality of panels comprising a top panel, a first side panel, a second side panel, and a bottom panel. End flaps are respectively foldably connected to respective panels of the plurality of panels, the end flaps for being at least partially overlapped with respect to one another to at least partially form a closed end of the carton formed from the blank. The blank further comprises dispenser features for forming a dispenser in the carton formed from the blank. The dispenser features comprise a dispenser panel and an opening section. The dispenser panel can be at least partially defined by a dispenser tear line extending in at least the top panel and at least one of the end flaps. The opening section can be at least partially defined by the dispenser tear line and can be foldably connected to one of the first side panel and the second side panel. The dispenser panel is for being at least partially removed from the carton formed from the blank to create a dispenser opening, and the opening section is for being positionable relative the one of the first side panel and the second side panel to expand the dispenser opening when the carton is formed from the blank.

In another aspect, the disclosure is generally directed to a method of forming a carton. The method comprising obtaining a blank comprising a plurality of panels comprising a top panel, a first side panel, a second side panel, and a bottom panel, end flaps respectively foldably connected to respective panels of the plurality of panels, and dispenser features comprising a dispenser panel and an opening section. The dispenser panel is at least partially defined by a dispenser tear line extending in at least the top panel and at least one of the end flaps, and the opening section is at least partially defined by the dispenser tear line and is foldably connected to one of the first side panel and the second side panel. the method further comprises forming an interior of the carton at least partially defined by the plurality of panels. The forming the interior of the carton comprises forming an open-ended sleeve. The method further comprises positioning the end flaps to be at least partially overlapped with respect to one another to at least partially close an end of the open-ended sleeve, at least partially forming a closed end of the carton. The forming the interior and the positioning the end flaps comprise forming a dispenser extending in at least the top panel and the closed end of the carton, the dispenser panel is at least partially removable from the carton to create a dispenser opening, and the opening section is positionable relative the first side panel to expand the dispenser opening.

In another aspect, the disclosure is generally directed to a method of opening a carton. The method comprises obtaining a carton comprising a plurality of panels that extend at least partially around an interior of the carton, end flaps respectively foldably connected to respective panels of the plurality of panels, and a dispenser comprising a dispenser panel and an opening section. The plurality of panels comprises a top panel, a first side panel, a second side panel, and a bottom panel. The end flaps are at least partially overlapped with respect to one another and thereby at least partially form a closed end of the carton. The dispenser panel is at least partially defined by a dispenser tear line extending in at least the top panel and at least one of the end flaps. The opening section is at least partially defined by the dispenser tear line and is foldably connected to one of the first side panel and the second side panel. The method further comprises removing the dispenser panel to form a dispenser opening by tearing along the dispenser tear line in at least the top panel and the at least one of the end flaps, and expanding the dispenser opening by pivoting the opening section relative to the one of the first side panel and the second side panel.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, metal; glass; aluminum and/or composite materials; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage bottles) as disposed within the carton embodiments. In this specification, the terms "lower," "bottom," "upper," and "top" indicate orientations determined in relation to fully erected and upright cartons.

Figure 1:
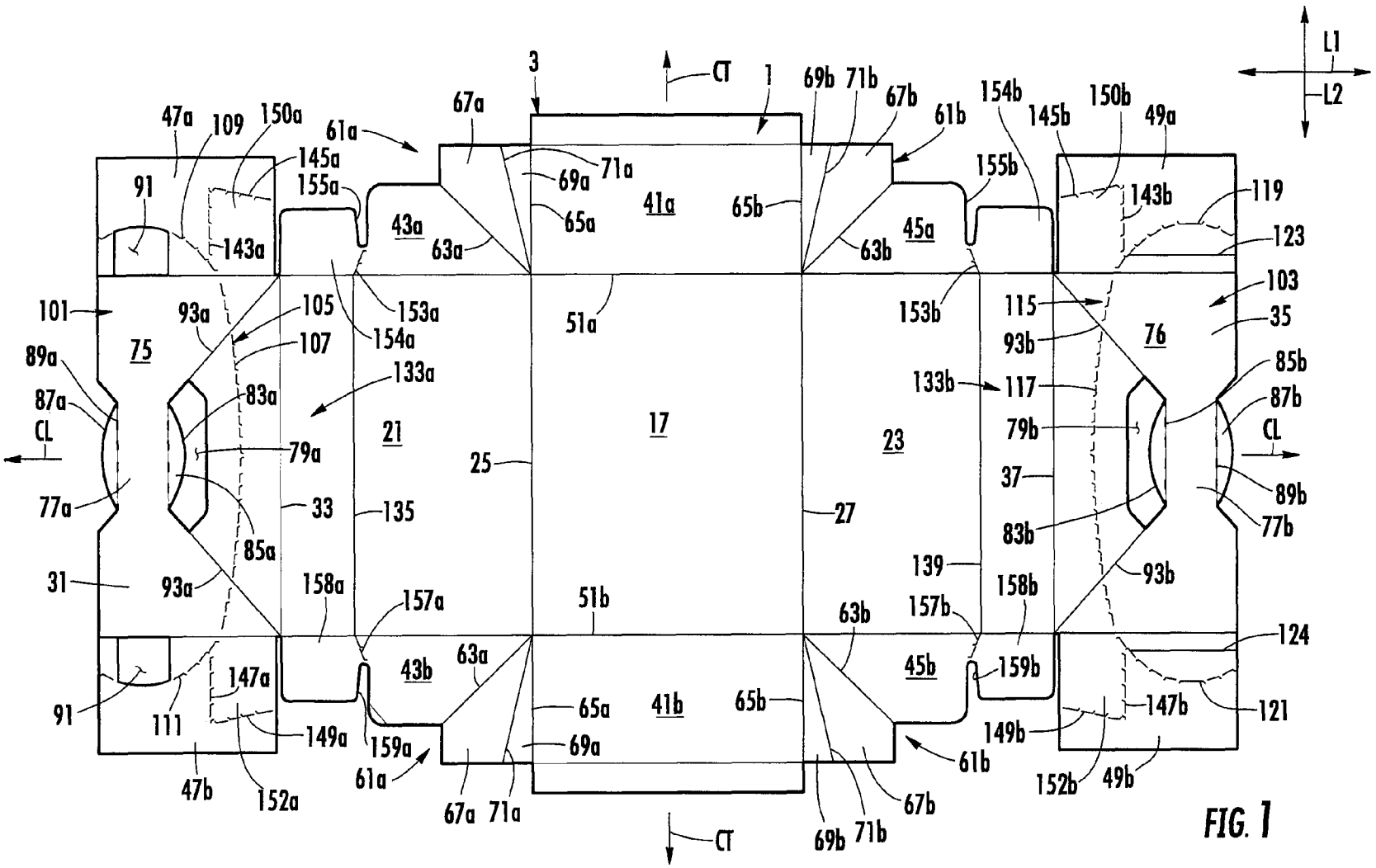
FIG. 1 is a plan view of a blank used to form a carton according to one embodiment of the disclosure.
Figure 5:
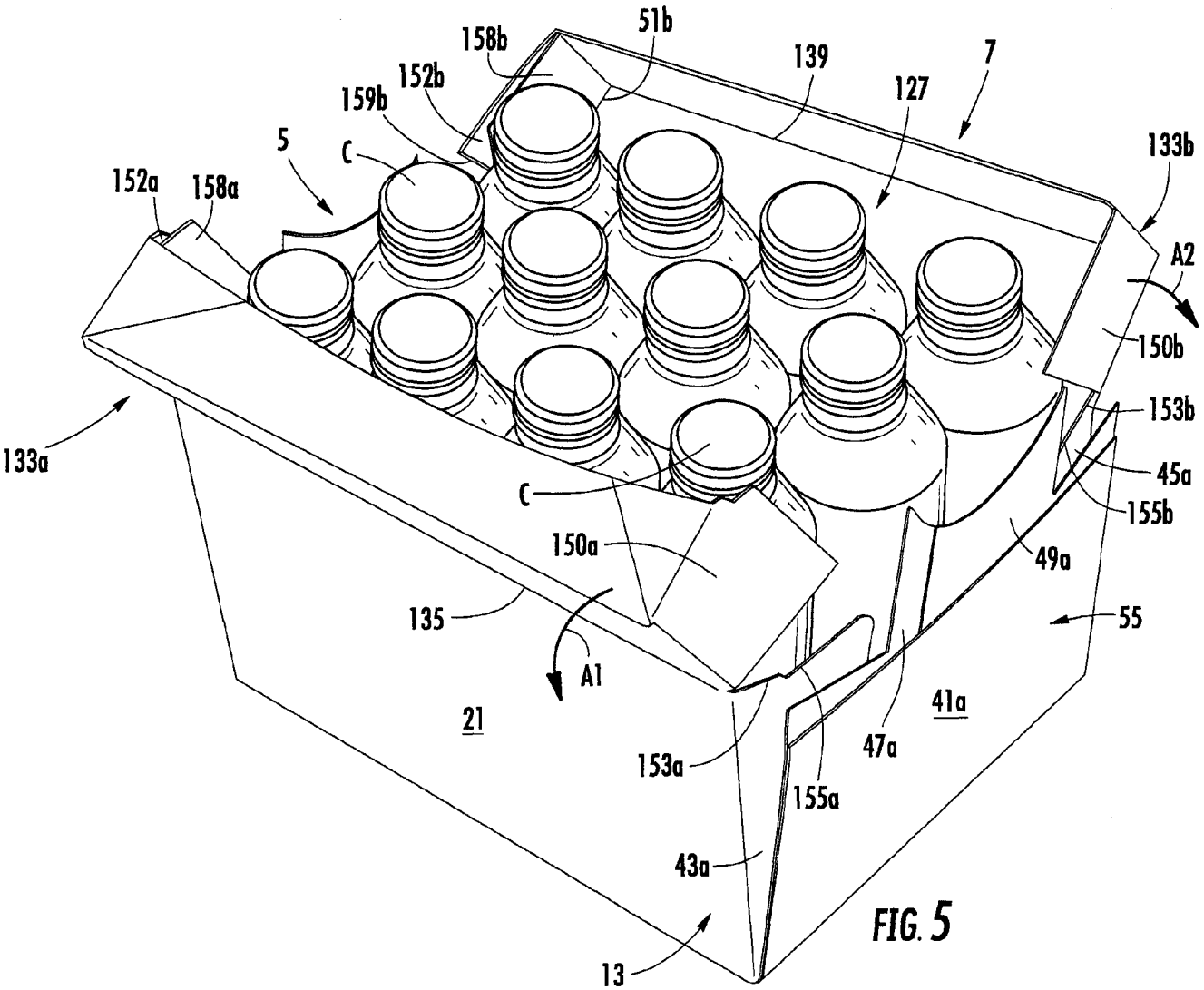
FIG. 5 is a perspective view of the carton of FIG. 4 with a first opening section and second opening section being pivoted outwardly.
Figure 6:
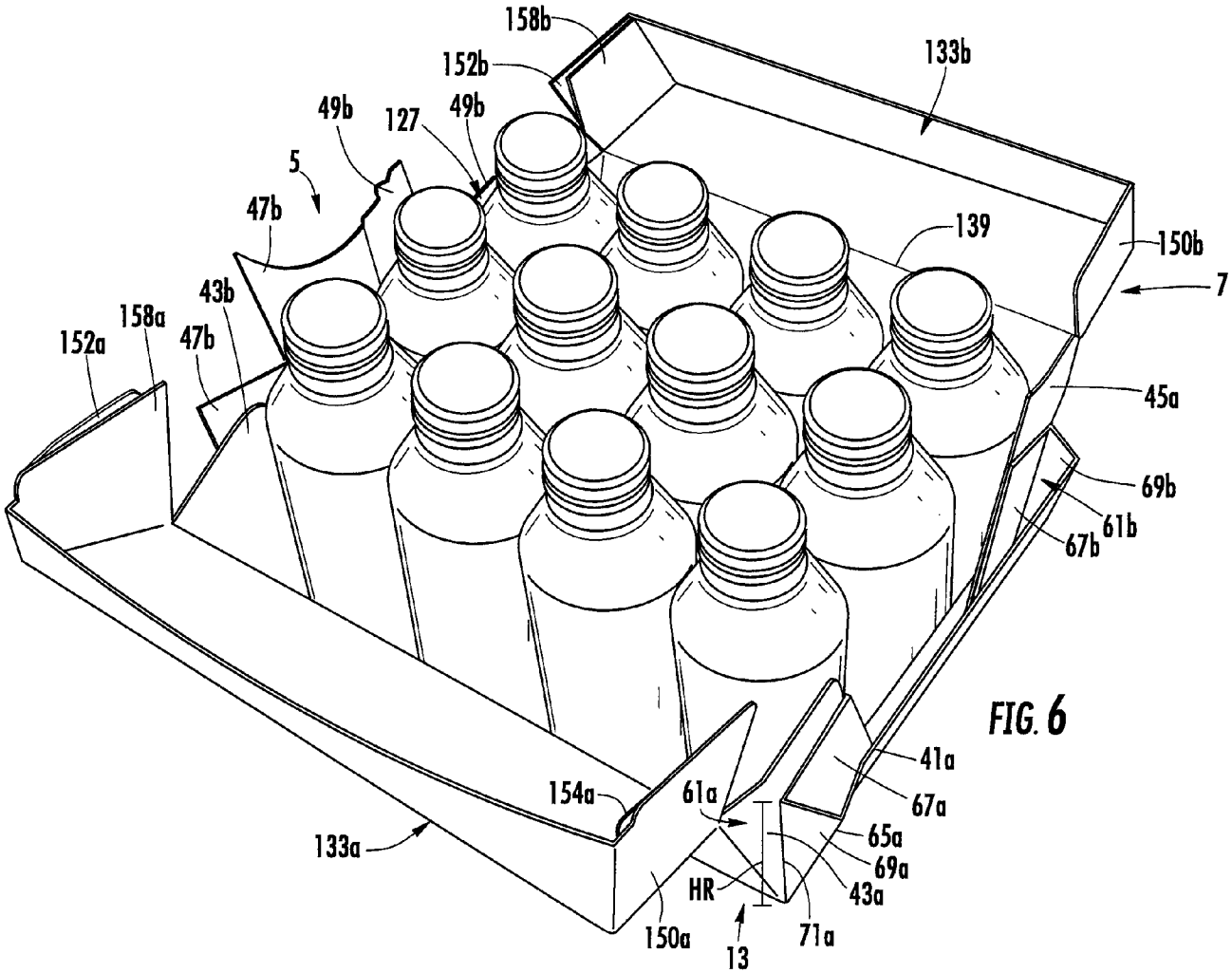
FIG. 6 is perspective view of the carton of FIG. 5 with a further expanded dispenser opening.

FIG. 1 is a plan view of the exterior side 1 of a blank, generally indicated at 3, used to form a carton 5 (FIG. 2) according to the exemplary embodiment of the disclosure. The carton 5 can be used to house a plurality of articles such as containers C (FIGS. 3-6). The carton 5 has a dispenser, generally indicated at 7 (FIG. 2), formed in the carton for allowing access to the containers from the top of the carton, and a handle, generally indicated at 11, formed in the top of the carton for grasping and carrying the carton. As shown in FIGS. 5 and 6, an expandable bottom receptacle 13 is formed in the bottom of the carton 5 for accommodating, for example, liquids, ice, or other coolants in the carton bottom. In one exemplary embodiment, ice can be added to the opened carton 5 to cool containers C, and beverages held therein. As the ice melts, all or a part of the resultant runoff water is held within the expandable bottom receptacle 13.

In the illustrated embodiment, the carton 5 is sized to house twelve containers C in a single layer in a 3×4 arrangement, but it is understood that the carton may be sized and shaped to hold containers of a different or same quantity in more than one layer and/or in different row/column arrangements (e.g., 1×6, 3×6, 2×6, 2×6×2, 3×4×2, 2×9, etc.).

The blank 3 has a longitudinal axis L1 and a lateral axis L2. As shown in FIG. 1, the blank 3 may have at least partial symmetry about a longitudinal center line $C_L$ and about a lateral center line $C_T$. Therefore, certain elements in the drawing figures have similar or identical reference numerals in order to reflect the whole or partial longitudinal and transverse symmetries and similar or like elements may be indicated by an "a" or "b" suffix designation for a corresponding reference number. The blank 3 comprises a bottom panel 17 foldably connected to first and second side panels 21, 23 at respective transverse fold lines 25, 27, a first top panel 31 foldably connected to the first side panel 21 at a transverse fold line 33, and a second top panel 35 foldably connected to the second side panel 23 at a transverse fold line 37. The first and second top panels 31, 35 at least partially overlap in the erected carton 5.

The bottom panel 17 is foldably connected to a first bottom end flap 41*a* and a second bottom end flap 41*b*. The first side panel 21 is foldably connected to a first side end flap 43*a* and a second side end flap 43*b*. The second side panel 23 is foldably connected to a first side end flap 45*a* and a second side end flap 45*b*. The first top panel 31 is foldably connected to a first top end flap 47*a* and a second top end flap 47*b*. The second top panel 35 is foldably connected to a first top end flap 49*a* and a second top end flap 49*b*.

The end flaps 41*a*, 43*a*, 45*a*, 47*a*, 49*a* extend along a first marginal area of the blank 3, and are foldably connected at a first longitudinal fold line 51*a* that extends along the length of the blank. The end flaps 41*b*, 43*b*, 45*b*, 47*b*, 49*b* extend along a second marginal area of the blank 3, and are foldably connected at a second longitudinal fold line 51*b* that also extends along the length of the blank. The longitudinal fold lines 51*a*, 51*b* may be, for example, substantially straight, or offset at one or more locations to account for blank thickness or for other factors. When the carton 5 is erected, the end flaps 41*a*, 43*a*, 45*a*, 47*a*, 49*a* close a first end 55 of the carton, and the end flaps 41*b*, 43*b*, 45*b*, 47*b*, 49*b* close a second end 57 of the carton. In accordance with an alternative embodiment of the present disclosure, different flap arrangements can be used for closing the ends 55, 57 of the carton 5.

Four gussets 61*a*, 61*b* are formed in the blank 3, one at each corner of the bottom panel 10. Two of the gussets 61*a* are respectively foldably connected to the respective side end flaps 43*a*, 43*b* of the first side panel 21 at oblique fold lines 63*a*, and to the respective bottom end flaps 41*a*, 41*b* at lateral fold lines 65*a*. Each gusset 61*a* comprises a first gusset panel 67*a* foldably connected to a second gusset panel 69*a* at an oblique fold line 71*a*. The other two gussets 61*b* are respectively foldably connected to the side flaps 45*a*, 45*b* of the second side panel 23 and the bottom end flaps 41*a*, 41*b* in a similar arrangement and manner as the gussets 61*a* and the gussets 61*b* have similar features as the gussets 61*a* (e.g., fold lines 63*b*, 65*b*, 71*b*, first gusset panels 67*b*, and second gusset panels 69*b*).

The features that comprise the handle 11 include a first handle panel 75 in the first top panel 31 and a second handle panel 76 in the second top panel 35. The features of the first handle panel 75 are indicated by reference numbers having the "a" suffix, and the features of the second handle panel 76 are indicated by reference numbers having a "b" suffix. The handle panels 75, 76 include a narrow gripping portion 77*a*, 77*b* centrally located in a respective top panel 31, 35. Each of the top panels 31, 35 includes an aperture 79*a*, 79*b* adjacent the respective gripping portions 77*a*, 77*b* and at least partially defining a respective first cushion portion 83*a*, 83*b* foldably connected to the respective gripping portions 77*a*, 77*b* at a respective lateral fold line 85*a*, 85*b*. Each of the handle panels 75, 76 has a respective second cushion portion 87*a*, 87*b* foldably connected to the respective gripping portions 77*a*, 77*b* at a respective lateral fold line 89*a*, 89*b*. The first handle panel 75 is at least partially defined by end handle apertures 91 that are formed in the end flaps 47*a*, 47*b* at the fold lines 51*a*, 51*b*. In one embodiment, the features that form the handle 11 include oblique fold lines 93*a*, 93*b* extending from the respective apertures 79*a*, 79*b* in the first top panel 31 and the second top panel 35. The handle panels 75, 76 could be otherwise shaped, arranged, and/or configured without departing from the disclosure, and the blank 3 could have other features for forming the handle 11 without departing from the disclosure.

In the illustrated embodiment, the features that form the dispenser 7 in the carton include a first dispenser panel 101 in the first top panel 31 and the top end flaps 47*a*, 47*b*, and a second dispenser panel 103 in the second top panel 35 and the top end flaps 49*a*, 49*b*. The first dispenser panel 101 and the second dispenser panel 103 are a least partially overlapped in the carton 5. The first dispenser panel 101 is formed by a tear line 105 comprising an arcuate portion 107 in the top panel 31, an arcuate portion 109 in the top end flap 47*a*, and an arcuate portion 111 in the top end flap 47*b*. The arcuate portions 109, 111 can be interrupted by the end handle apertures 91 in the respective top end flaps 47*a*, 47*b*. The second dispenser panel 103 is formed by a similarly shaped tear line 115 having respective arcuate portions 117, 119, 121. In the illustrated embodiment, the tear lines 105, 115 cooperate to form a generally oval-shaped dispenser panel 125 (FIG. 2) from the partially overlapped first and second dispenser panels 101, 103. The dispenser panel 125 extends across the top of the carton and into the ends of the carton. The dispenser panel 125 can be separated from the carton along the tear lines 105, 115 to create a dispenser opening 127 (FIGS. 3 and 4) for accessing the containers C. Opening of the dispenser panel 125 can be facilitated by scores or fold lines 123, 124 in the portions of the second dispenser panel 103 in the respective top end flaps 49*a*, 49*b*. The fold lines 123, 124 can allow the ends of the dispenser panel 125 to be folded inwardly to initiate tearing along the fold lines 105, 115. The first dispenser panel 101, the second dispenser panel 103, and/or the tear lines 105, 115 can be otherwise shaped, arranged, and/or configured without departing from the disclosure.

In the illustrated embodiment, the blank 3 includes a first opening section 133*a* foldably connected to the first side panel 21 at a lateral fold line 135 extending across the first side panel, and a second opening section 133*b* foldably connected to the second side panel 23 at a lateral fold line 139 extending across the second side panel. The first opening section 133*a* is at least partially defined by the arcuate portion 107 of the tear line 105 in the first top panel 31, a lateral tear line 143*a* in the top end flap 47*a*, an oblique tear line 145*a* in the top end flap 47*a*, a lateral tear line 147*a* in the top end flap 47*b*, and an oblique tear line 149*a* in the top end flap 47*b*. The lateral tear line 143*a* and the oblique tear line 145*a* can at least partially define an end portion 150*a* of the opening section 133*a* in the top end flap 47*a*, and the lateral fold line 147*a* and the oblique tear line 149*a* can at least partially define an end portion 152*a* of the opening section 133*a* in the top end flap 47*b*. Also, the first opening section 133*a* is defined by an oblique tear line 153*a* extending from the longitudinal fold line 51*a* to a notch 155*a* in the side end flap 43*a* and an oblique tear line 157*a* extending from the longitudinal fold line 51*b* to a notch 159*a* in the side end flap 43*b*. The tear lines 153*a*, 157*a* can extend from respective ends of the lateral fold line 135 in one embodiment. The tear lines 153*a*, 157*a* and the notches 155*a*, 159*a* can define respective upper portions 154*a*, 158*a* of the respective side end flaps 43*a*, 43*b*. The upper portions 154*a*, 158*a* of the side end flaps 43*a*, 43*b* can be glued to the respective end portions 150*a*, 152*a* of the opening section 133*a* to form the ends of the opening section 133*a* in the carton 5. Additionally, the oblique tear lines 145*a*, 149*a* can at least partially overlap the respective tear lines 153*a*, 157*a* when the ends of the opening section 133*a* are formed. The first opening section 133*a* could be otherwise shaped, arranged, configured, and/or omitted without departing from the disclosure.

In one embodiment, the second opening section 133*b* is similarly shaped as the opening section 133*a* and has similar or identical features designated by a "b" suffix on the reference numbers. The opening section 133*b* is at least partially defined by tear lines 117, 143*b*, 145*b*, 147*b*, 149*b*, 153*b*, 157*b*, notches 155*b*, 159*b*, and the fold line 139. Upper portions 154*b*, 158*b* of the respective side end flaps 45*a*, 45*b* can be glued to respective end portions 150*b*, 152*b* of the opening section 133*b* to form the ends of the opening section 133*b* in the carton 5. The second opening section 133*b* could be otherwise shaped, arranged, configured and/or omitted without departing from the disclosure.

An exemplary method of erecting the carton 5 is discussed below. Glue or other adhesive is applied to the upper or exterior side of the first top panel 31 and all or a portion of the top end flaps 47*a*, 47*b*, 49*a*, 49*b* may also have glue applied thereto. Portions of the side end flaps 43*a*, 43*b* that will overlap one or more of the gusset panels 67*a*, 67*b* may also have glue applied thereto. The first and second top panels 31, 35 are overlapped and secured together with the gripping portions 77*a*, 77*b* of the respective first and second handle panels 75, 76 overlapped to form the handle 11. The side panels 21, 23 are folded relative to the bottom panel 17 and the overlapped top panels 31, 35 to form a generally open-ended sleeve. Containers C can be loaded into the open-ended sleeve. Alternatively, one end of the sleeve can be closed prior to loading the containers C.

Figure 2:
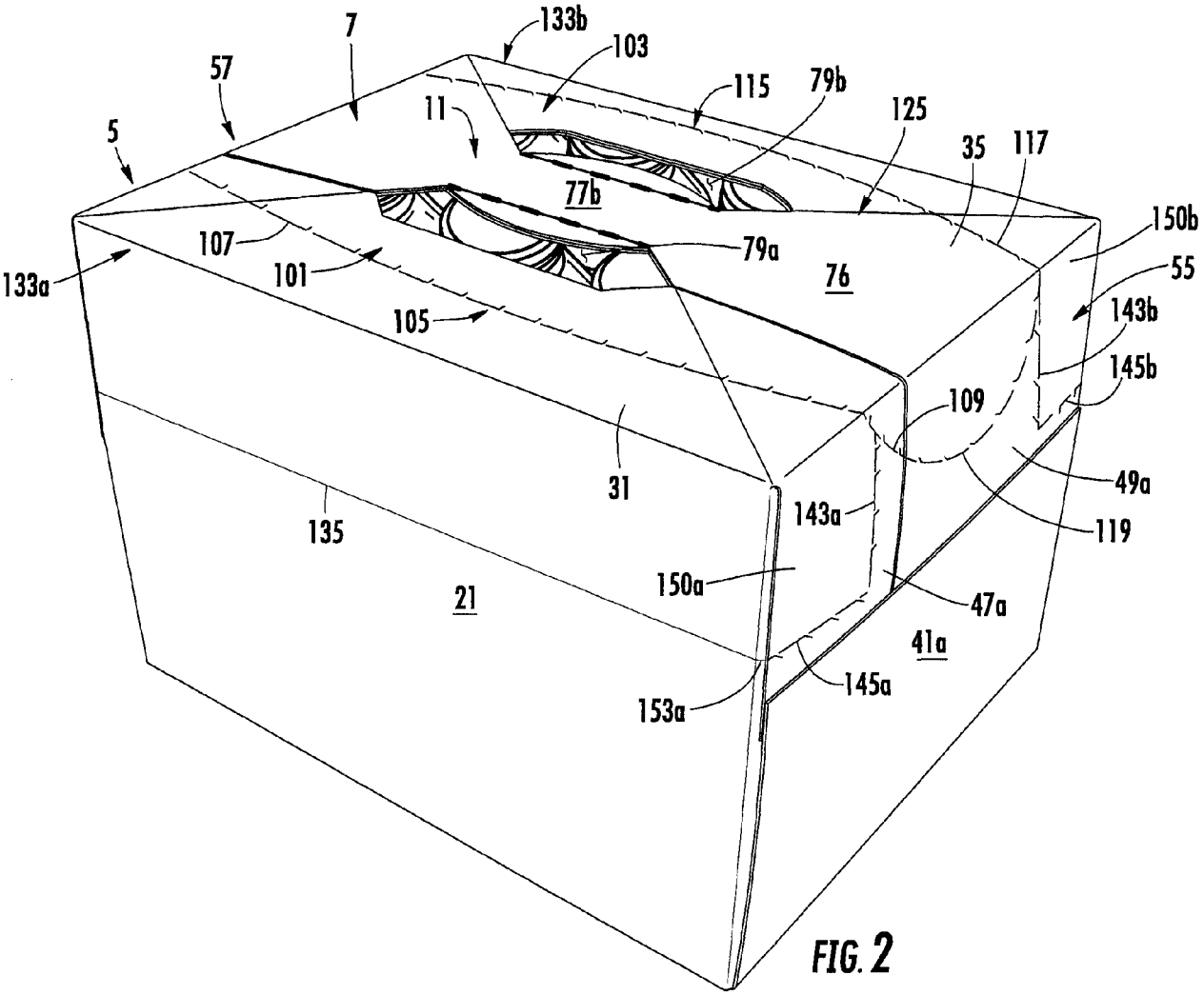
FIG. 2 is a perspective view of the carton assembled from the blank.

After loading the containers C, the end flaps 41*a*, 43*a*, 45*a*, 47*a*, 49*a* can be overlapped and secured to close the first end 55 of the carton 5 (FIG. 2), and the end flaps 41*b*, 43*b*, 45*b*, 47*b*, 49*b* can be overlapped and secured to close the second end 57 of the carton (FIG. 2). During the closing of the ends 55, 57 the gusset panels 67*a*, 67*b* and the gusset panels 69*a*, 69*b* can be folded to be in face-to-face contact with the respective side end flaps 43*a*, 43*b*, 45*a*, 45*b*, with the gusset panels 67*a*, 67*b* being adhesively secured to the respective side end flaps 43*a*, 43*b*, 45*a*, 45*b*. In this manner the expandable bottom receptacle 13 can be formed. A portion of each of the bottom end flaps 41*a*, 41*b* can be adhered to a portion of the respective top end flaps 47*a*, 49*a* and 47*b*, 49*b*. Additionally, during the closing of the ends 55, 57, the upper portions 154*a*, 158*a*, 154*b*, 158*b* of the respective side end flaps 43*a*, 43*b*, 45*a*, 45*b* can be glued to the respective end portions 150*a*, 152*a*, 150*b*, 152*b* to form the respective ends of the opening sections 133*a*, 133*b*. The carton 5 can be alternatively erected without departing from the disclosure.

In the illustrated embodiment, the handle 11 is a two-ply handle formed by the overlapped first and second handle panels 75, 76, but the carton 5 could have other handle arrangements that are other than two-ply (e.g., single-play, three-ply, etc.) without departing from the disclosure. The carton 5 may be, for example, parallelepipedal or generally parallelepipedal in shape, or may be other shapes without departing from the disclosure.

Figure 3:
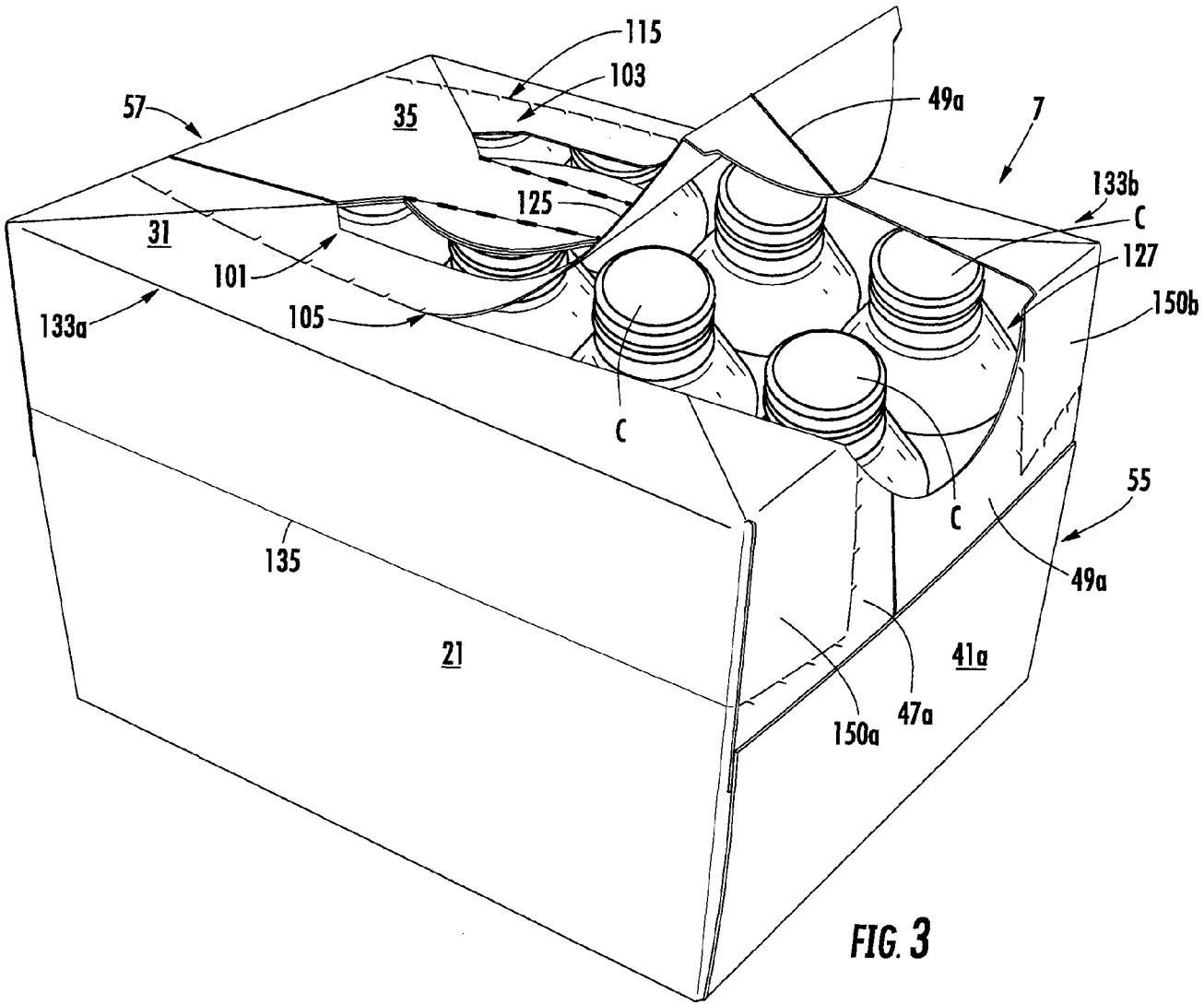
FIG. 3 is a perspective view of the carton with a dispenser panel being removed.
Figure 4:
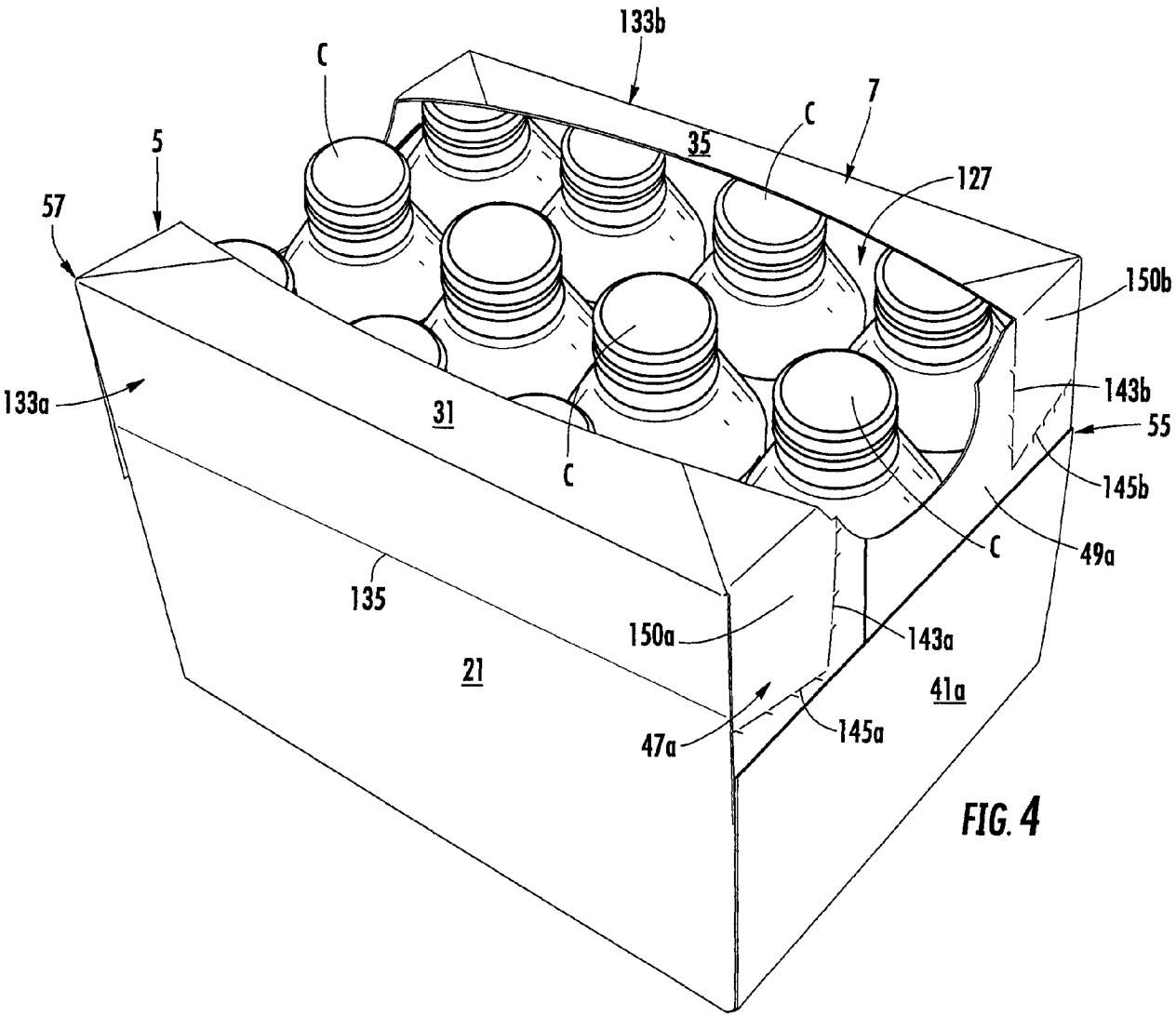
FIG. 4 is a perspective view of the carton with the dispenser panel removed to create a dispenser opening.

As shown in FIGS. 3 and 4, the dispenser 7 is activated to an initially opened condition (FIG. 4) by breaching the carton along the tear lines 105, 115 to separate the dispenser panel 125 from the carton and create the dispenser opening 127 for accessing the containers C. As shown in FIGS. 5 and 6, the dispenser opening 127 can be expanded by separating the first opening section 133*a* and second opening section 133*b* from the ends 55, 57 of the carton 5 and pivoting the opening sections about respective fold lines 135, 139. The first opening section 133*a* is separated from the ends 55, 57 by tearing along tear lines 143*a*, 145*a*, 147*a*, 149*a*, 153*a*, 157*a* and the second opening section is separated from the ends 55, 57 by tearing along tear lines 143*b*, 145*b*, 147*b*, 149*b*, 153*b*, 157*b*. As shown in FIG. 5 each opening section 133*a*, 133*b* can be pivoted outwardly in the direction of arrows A1, A2 to expand the dispenser opening 127. The expanded dispenser opening 127 (FIG. 6) of the carton 5 allows the carton to accommodate ice or other coolant.

According to the above embodiment, ice, cold water, additional containers, or other items, for example, can be placed in the carton 5 through the expanded dispenser opening 127. The gussets 61*a*, 61*b*, the bottom end panels 41*a*, 41*b*, the side end flaps 43*a*, 43*b*, 45*a*, 45*b*, and lower portions of the side panels 21, 23 at least partially close the bottom portion of the carton 5 and create the at least partially closed expandable bottom receptacle 13 in the bottom of the carton. Prior to separating the opening sections 133*a*, 133*b* from the ends 55, 57 of the carton 5 (FIGS. 2-4), the top end flaps 47*a*, 47*b*, 49*a*, 49*b* are retained against the respective side end flaps 43*a*, 43*b*, 45*a*, 45*b* since the upper portions 154*a*, 158*a*, 154*b*, 158*b* are glued to the end portions 150*a*, 152*a*, 150*b*, 152*b*. Since the bottom end flaps 41*a*, 41*b* are glued to the top end flaps 47*a*, 47*b*, 49*a*, 49*b*, the bottom end flaps 41*a*, 41*b* are retained against the gussets 61*a*, 61*b* and the side end flaps 43*a*, 43*b*, 45*a*, 45*b*. Once the opening sections 133*a*, 133*b* are separated from the ends 55, 57 of the carton 5 (FIGS. 5 and 6), the remainders of the top end flaps 47*a*, 47*b*, 49*a*, 49*b* and the bottom end flaps 41*a*, 41*b* are free to pivot away from the side end flaps 43*a*, 43*b*, 45*a*, 45*b*. Accordingly, the gusset panels 69*a*, 69*b* can fold with respect to the side end flaps 43*a*, 43*b*, 45*a*, 45*b* and the bottom end flaps 41*a*, 41*b*. Accordingly, the side panels 21, 23 can pivot somewhat about the respective transverse fold lines 25, 27, and the bottom end flaps 41*a*, 41*b* can pivot somewhat about the respective longitudinal fold lines 51*a*, 51*b*. Accordingly, the gussets 61*a*, 61*b* allow further opening of the dispenser opening 127. Additionally, the expandable bottom receptacle 13 of the opened carton 5 can be used to retain liquids, such as water formed from melting ice, condensation, other liquids, and articles such as, for example, refuse or fine particulate matter such as powders.

The expandable bottom receptacle 13 may have a height $H_R$ below which the carton 5 is liquid-tight. The height $H_R$ represents a portion of the bottom of the carton 5 below which no glued seals or seams are formed through which water or other liquid might leak. In one embodiment, the height $H_R$ is approximately equal to the length of the fold line 71*a*, 71*b* connecting the gusset panel 67*a*, 67*b* with the gusset panel 69*a*, 69*b*. That is, in accordance with the illustrated embodiment, no adhesive seal or other joinder of material where fluid might escape the carton 5 is located in the carton below the height $H_R$. The expandable bottom receptacle 13 may therefore be formed from a continuous section of folded material of the blank 3. The height $H_R$ of the liquid-tight portion of the receptacle 13 below which there are no glued seams may generally be between approximately 0 inches to approximately 4 inches (approximately 0 mm to approximately 102 mm), and, more preferably, may be approximately 2¾ inches (approximately 70 mm). It is understood that all dimensional information presented herein is intended to be illustrative and is not intended to be used to limit the scope of the disclosure.

Cartons or blanks according to the principles of the present disclosure may be formed from materials such as paperboard. Therefore, if exposed to water or other liquids for extended periods of time, the carton may allow for the passage of liquid through the wetted carton surfaces due to partial permeability of the carton material. In this specification, the term "liquid-tight" is generally used to define a section of a carton that is formed from a continuous section of material or of a section without any glued seams through which liquid or fine particulate matter might leak, and the term "liquid-tight" therefore encompasses cartons that may become partially water permeable over time.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. For example, the caliper can be at least about 24, but the caliper may be more or less than this amount without departing from the disclosure. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiment of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A carton for containing a plurality of articles, the carton comprising:

a plurality of panels that extend at least partially around an interior of the carton, the plurality of panels comprising a top panel, a first side panel, a second side panel, and a bottom panel;

end flaps respectively foldably connected to respective panels of the plurality of panels, the end flaps being at least partially overlapped with respect to one another and thereby at least partially form a closed end of the carton, wherein the end flaps comprise at least a top end flap foldably connected to the top panel; and a dispenser comprising a dispenser panel and an opening section, the dispenser panel being at least partially defined by a dispenser tear line comprising at least a first portion extending in at least the top panel and a second portion extending in the top end flap from an end of the first portion, the opening section being at least partially defined by the dispenser tear line in at least the top panel and an end tear line in the top end flap, the opening section being foldably connected to the first side panel, wherein the second portion of the dispenser tear line extends from the first end tear line in the top end flap away from the opening section so that the dispenser tear line is spaced apart from the first side panel by at least a portion of the opening section, the dispenser panel is at least partially removable from the carton to create a dispenser opening, and the opening section is positionable relative the first side panel to expand the dispenser opening;

wherein the second portion of the dispenser tear line extends to an edge of the top end flap that is spaced apart from the first side panel and the second side panel.

2. The carton of claim 1, wherein the dispenser panel is separable from the opening section along at least a portion of the first portion of the dispenser tear line.

3. The carton of claim 2, wherein the end tear line is a first end tear line and the opening section is further defined by a second end tear line extending in the top end flap.

4. The carton of claim 3, wherein the first end tear line extends from the dispenser tear line and the second end tear line extends from the first end tear line.

5. The carton of claim 3, wherein the end flaps further comprise a side end flap foldably connected to the first side panel, and the opening section is foldably connected to the first side panel along a lateral fold line.

6. The carton of claim 5, wherein the opening section is further defined by a third end tear line extending in the side end flap from an end of the lateral fold line, the second end tear line at least partially overlapping the third end tear line.

7. The carton of claim 6, wherein:

the first end tear line extends in a generally lateral direction, and the second end tear line and the third end tear line are oblique with respect to the first end tear line; and the second portion of the dispenser tear line is arcuate and extends to a first edge of the top end flap, and the second end tear line extends to an opposing second edge of the top end flap, the second edge of the top end flap being disposed adjacent the first side panel.

8. The carton of claim 1, wherein:

the top panel is a first top panel, the dispenser panel is a first dispenser panel, and the dispenser tear line is a first dispenser tear line;

the carton comprises a second top panel;

the dispenser further comprises a second dispenser panel, the second dispenser panel being at least partially defined by a second dispenser tear line extending in at least the second top panel; and the second dispenser panel at least partially overlaps the first dispenser panel.

9. The carton of claim 8, wherein the opening section is a first opening section, the first opening section being foldably connected to the first side panel along a first fold line, and the dispenser further comprises a second opening section that is at least partially defined by the second dispenser tear line and is foldably connected to the second side panel along a second fold line.

10. The carton of claim 9, wherein:

the top end flap is a first top end flap;

the end flaps further comprise at least a second top end flap foldably connected to the second top panel;

the first dispenser panel is separable from the first opening section along at least a portion of the first portion of the first dispenser tear line; and the second dispenser tear line comprises a third portion extending in the second top panel and a fourth portion extending in the second top end flap from an end of the third portion, the second dispenser panel being separable from the second opening section along at least a portion of the third portion of the second dispenser tear line.

11. The carton of claim 10, wherein the end tear line is a first end tear line and the first opening section is further defined by a second end tear line extending in the first top end flap, the first end tear line extending from the first dispenser tear line and the second end tear line extending from the first end tear line, and the second opening section is further defined by a third end tear line and a fourth end tear line each extending in the second top end flap, the third end tear line extending from the second dispenser tear line and the fourth end tear line extending from the third end tear line.

12. The carton of claim 11, wherein:

the end flaps further comprise a first side end flap foldably connected to the first side panel and a second side end flap foldably connected to the second side panel;

the first opening section is further defined by a fifth end tear line extending in the first side end flap from an end of the first end fold line, the second end tear line at least partially overlapping the fifth end tear line; and the second opening section is further defined by a sixth end tear line extending in the second side end flap from an end of the third end fold line, the fourth end tear line at least partially overlapping the sixth end tear line.

13. The carton of claim 12, wherein:

the second portion of the first dispenser tear line is arcuate and extends to a first edge of the first top end flap, and the fourth portion of the second dispenser tear line is arcuate and extends to a second edge of the second top end flap; and the second top end flap at least partially overlaps the first top end flap, and the second portion of the first dispenser tear line at least partially overlaps the fourth portion of the second dispenser tear line.

14. The carton of claim 9, wherein the end flaps further comprise a bottom end flap foldably connected to the bottom panel and a side end flap foldably connected to one of the first side panel and the second side panel, the bottom end flap being connected to the side end flap by a gusset.

15. The carton of claim 14, wherein:

the side end flap is a first side end flap and the end flaps further comprise a second side end flap;

the gusset is a first gusset and the bottom end flap is connected to the second side end flap by a second gusset; and at least the first gusset, the second gusset, the bottom end flap, and lower portions of the first side panel and the second side panel form an expandable bottom receptacle for expanding the dispenser opening after the first dispenser panel and the second dispenser panel are removed and the first opening section and the second opening section are pivoted along the respective first lateral fold line and second lateral fold line.

16. The carton of claim 15, wherein the first gusset and the second gusset each comprise a first gusset panel and a second gusset panel, the first gusset panels being foldably connected to the bottom end flap and the respective second gusset panels, the second gusset panel of the first gusset being overlapped with and adhered to the first side end panel and the first gusset panel of the second gusset being overlapped with and adhered to the second side end flap, the first gusset panels being free to pivot relative to the bottom end flap and the respective second gusset panels.

17. The carton of claim 16, wherein:

the top end flap is a first top end flap, and the end tear line is a first end tear line;

the end flaps further comprise at least a second top end flap foldably connected to the second top panel;

the bottom end flap at least partially overlaps and is adhered to the first top end flap and the second top end flap;

the first opening section comprises a first end portion and a second end portion, the first end portion being at least partially defined by at least the first end tear line extending in the first top end flap, and the second end portion being at least partially defined by at least one second end tear line extending in the second top end flap;

each of the first side end flap and the second side end flap comprises a respective first upper portion and second upper portion, the first upper portion being at least partially defined by a third end tear line, and the second upper portion being at least partially defined by a fourth end tear line; and the first end portion of the first opening section at least partially overlaps and is adhered to the first upper portion of the first side end flap, and the second end portion of the second opening section at least partially overlaps and is adhered to the second upper section of the second side end flap.

18. The carton of claim 8, further comprising a handle comprising a first handle panel extending in at least the first dispenser panel and a second handle panel extending in the second dispenser panel, the first handle panel comprising a first gripping portion, and the second handle panel comprising a second gripping portion, wherein the first gripping portion at least partially overlaps the second gripping portion.

19. The carton of claim 1, wherein:

the end flaps comprise at least one side end flap foldably connected to at least one of the first side panel and the second side panel and a bottom end flap foldably connected to the bottom panel; and the bottom end flap is connected to the at least one side end flap by a gusset.

20. The carton of claim 19, wherein the gusset comprises a first gusset panel foldably connected to the bottom end flap and a second gusset panel foldably connected to the first gusset panel and the at least one side end flap, and wherein the second gusset panel at least partially overlaps and is adhered to the at least one side end flap.

21. The carton of claim 19, wherein:

the at least one side end flap comprises a first side end flap foldably connected to the first side panel and a second side end flap foldably connected to the second side panel;

the gusset is a first gusset foldably connected to the bottom end flap and the first side end flap, and a second gusset is foldably connected to the bottom end flap and the second side end flap; and at least the bottom end flap, the first gusset, the second gusset, and lower portions of the first side panel and the second side panel form an expandable bottom receptacle for expanding the dispenser opening after the dispenser panel is removed and the opening section is pivoted relative to the first side panel.

22. The carton of claim 1, further comprising a handle comprising a handle panel extending in at least the dispenser panel.

23. The carton of claim 1, wherein:

the top panel is foldably connected to the first side panel along a first lateral fold line and the opening section is foldably connected to the first side panel along a second lateral fold line; and the opening section comprises a top portion in the top panel and a side portion in the side panel, the top portion being at least partially defined by the dispenser tear line and the first lateral fold line, and the side portion being at least partially defined by the first lateral fold line and the second lateral fold line.

24. The carton of claim 23, wherein the opening section further comprises an end portion in at least the top end flap, the end portion being at least partially defined by the end tear line.

25. A blank for forming a carton, the blank comprising:

a plurality of panels comprising a top panel, a first side panel, a second side panel, and a bottom panel;

end flaps respectively foldably connected to respective panels of the plurality of panels, the end flaps for being at least partially overlapped with respect to one another to at least partially form a closed end of the carton formed from the blank, wherein the end flaps comprise at least a top end flap foldably connected to the top panel; and dispenser features for forming a dispenser in the carton formed from the blank, the dispenser features comprising a dispenser panel and an opening section, the dispenser panel being at least partially defined by a dispenser tear line comprising at least a first portion extending in at least the top panel and a second portion extending in the top end flap from an end of the first portion, the opening section being at least partially defined by the dispenser tear line in at least the top panel and an end tear line in the top end flap, the opening section being foldably connected to the first side panel, wherein the second portion of the dispenser tear line extends from the first end tear line in the top end flap away from the opening section so that the dispenser tear line is spaced apart from the first side panel by at least a portion of the opening section when the carton is formed from the blank, the dispenser panel for being at least partially removed from the carton formed from the blank to create a dispenser opening, and the opening section for being positionable relative to the first side panel to expand the dispenser opening when the carton is formed from the blank;

wherein the second portion of the dispenser tear line extends to an edge of the top end flap that is spaced apart from the first side panel and the second side panel when the carton is formed from the blank.

26. The blank of claim 25, wherein the dispenser panel is separable from the opening section along at least a portion of the first portion of the dispenser tear line.

27. The blank of claim 26, wherein the end tear line is a first end tear line and the opening section is further defined by a second end tear line extending in the top end flap.

28. The blank of claim 27, wherein the first end tear line extends from the dispenser tear line and the second end tear line extends from the first end tear line.

29. The blank of claim 27, wherein the end flaps further comprise a side end flap foldably connected to the first side panel, and the opening section is foldably connected to the first side panel along a lateral fold line.

30. The blank of claim 29, wherein the opening section is further defined by a third end tear line extending in the side end flap from an end of the lateral fold line, the second end tear line is for at least partially overlapping the third end tear line when the carton is formed from the blank.

31. The blank of claim 30, wherein:

the first end tear line extends in a generally lateral direction, and the second end tear line and the third end tear line are oblique with respect to the first end tear line; and the second portion of the dispenser tear line is arcuate and extends to a first edge of the top end flap, and the second end tear line extends to an opposing second edge of the top end flap, the second edge of the top end flap for being disposed adjacent the first side panel when the carton is formed from the blank.

32. The blank of claim 25, wherein:

the top panel is a first top panel, the dispenser panel is a first dispenser panel, and the dispenser tear line is a first dispenser tear line;

the carton comprises a second top panel;

the dispenser further comprises a second dispenser panel, the second dispenser panel being at least partially defined by a second dispenser tear line extending in at least the second top panel; and the second dispenser panel is for at least partially overlapping the first dispenser panel when the carton is formed from the blank.

33. The blank of claim 32, wherein the opening section is a first opening section, the first opening section being foldably connected to the first side panel along a first fold line, and the dispenser further comprises a second opening section that is at least partially defined by the second dispenser tear line and is foldably connected to the second side panel along a second fold line.

34. The blank of claim 33, wherein:

the top end flap is a first top end flap;

the end flaps further comprise at least a second top end flap foldably connected to the second top panel;

the first dispenser panel is separable from the first opening section along at least a portion of the first portion of the first dispenser tear line; and the second dispenser tear line comprises a third portion extending in the second top panel and a fourth portion extending in the second top end flap from an end of the third portion, the second dispenser panel being separable from the second opening section along at least a portion of the third portion of the second dispenser tear line.

35. The blank of claim 34, wherein the end tear line is a first end tear line and the first opening section is further defined by a second end tear line extending in the first top end flap, the first end tear line extending from the first dispenser tear line and the second end tear line extending from the first end tear line, and the second opening section is further defined by a third end tear line and a fourth end tear line each extending in the second top end flap, the third end tear line extending from the second dispenser tear line and the fourth end tear line extending from the third end tear line.

36. The blank of claim 35, wherein:

the end flaps further comprise a first side end flap foldably connected to the first side panel and a second side end flap foldably connected to the second side panel;

the first opening section is further defined by a fifth end tear line extending in the first side end flap from an end of the first end fold line, the second end tear line being for at least partially overlapping the fifth end tear line when the carton is formed from the blank; and the second opening section is further defined by a sixth end tear line extending in the second side end flap from an end of the third end fold line, the fourth end tear line being for at least partially overlapping the sixth end tear line when the carton is formed from the blank.

37. The blank of claim 36, wherein:

the second portion of the first dispenser tear line is arcuate and extends to a first edge of the first top end flap, and the fourth portion of the second dispenser tear line is arcuate and extends to a second edge of the second top end flap; and the second top end flap is for at least partially overlapping the first top end flap when the carton is formed from the blank, and the second portion of the first dispenser tear line is for at least partially overlapping the fourth portion of the second dispenser tear line when the carton is formed from the blank.

38. The blank of claim 33, wherein the end flaps further comprise a bottom end flap foldably connected to the bottom panel and a side end flap foldably connected to one of the first side panel and the second side panel, the bottom end flap being connected to the side end flap by a gusset.

39. The blank of claim 38, wherein:

the side end flap is a first side end flap and the end flaps further comprise a second side end flap;

the gusset is a first gusset and the bottom end flap is connected to the second side end flap by a second gusset; and at least the first gusset, the second gusset, the bottom end flap, and lower portions of the first side panel and the second side panel are for forming an expandable bottom receptacle when the carton is formed from the bank.

40. The blank of claim 39, wherein the first gusset and the second gusset each comprise a first gusset panel and a second gusset panel, the first gusset panels being foldably connected to the bottom end flap and the respective second gusset panels, the second gusset panel of the first gusset being for overlapping the first side end panel when the carton is formed from the blank and the first gusset panel of the second gusset being for overlapping the second side end flap when the carton is formed from the blank.

41. The blank of claim 32, further comprising a handle comprising a first handle panel extending in at least the first dispenser panel and a second handle panel extending in the second dispenser panel, the first handle panel comprising a first gripping portion, and the second handle panel comprising a second gripping portion, wherein the first gripping portion is for at least partially overlapping the second gripping portion when the carton is formed from the blank.

42. The blank of claim 25, wherein:

the end flaps comprise at least one side end flap foldably connected to at least one of the first side panel and the second side panel and a bottom end flap foldably connected to the bottom panel; and the bottom end flap is connected to the at least one side end flap by a gusset.

43. The blank of claim 42, wherein the gusset comprises a first gusset panel foldably connected to the bottom end flap and a second gusset panel foldably connected to the first gusset panel and the at least one side end flap, and wherein the second gusset panel is for at least partially overlapping the at least one side end flap.

44. The blank of claim 42, wherein:

the at least one side end flap comprises a first side end flap foldably connected to the first side panel and a second side end flap foldably connected to the second side panel;

the gusset is a first gusset foldably connected to the bottom end flap and the first side end flap, and a second gusset is foldably connected to the bottom end flap and the second side end flap; and at least the bottom end flap, the first gusset, the second gusset, and lower portions of the first side panel and the second side panel are for forming an expandable bottom receptacle when the carton is formed from the blank.

45. The blank of claim 25, further comprising handle features comprising a handle panel extending in at least the dispenser panel.

46. The blank of claim 25, wherein:

the top panel is foldably connected to the first side panel along a first lateral fold line and the opening section is foldably connected to the first side panel along a second lateral fold line; and the opening section comprises a top portion in the top panel and a side portion in the side panel, the top portion being at least partially defined by the dispenser tear line and the first lateral fold line, and the side portion being at least partially defined by the first lateral fold line and the second lateral fold line.

47. The blank of claim 46, wherein the opening section further comprises an end portion in at least the top end flap, the end portion being at least partially defined by the end tear line.

48. A method of forming a carton comprising:

obtaining a blank comprising a plurality of panels comprising a top panel, a first side panel, a second side panel, and a bottom panel, end flaps respectively foldably connected to respective panels of the plurality of panels, and dispenser features comprising a dispenser panel and an opening section, wherein the end panels comprise at least a top end flap foldably connected to the top panel, wherein the dispenser panel is at least partially defined by a dispenser tear line comprising a first portion extending in at least the top panel and a second portion extending in the top end flap from an end of the first portion, and the opening section is at least partially defined by the dispenser tear line in at least the top panel and an end tear line in the top end flap, the opening section being foldably connected to the first side panel;

forming an interior of the carton at least partially defined by the plurality of panels, the forming the interior of the carton comprising forming an open-ended sleeve;

positioning the end flaps to be at least partially overlapped with respect to one another to at least partially close an end of the open-ended sleeve, at least partially forming a closed end of the carton;

wherein the forming the interior and the positioning the end flaps comprise forming a dispenser extending in at least the top panel and the closed end of the carton, the dispenser panel is at least partially removable from the carton to create a dispenser opening, the opening section is positionable relative the first side panel to expand the dispenser opening, and the second portion of the dispenser tear line extends from the first end tear line in the top end flap away from the opening section so that the dispenser tear line is spaced apart from the first side panel by at least a portion of the opening section, wherein the second portion of the dispenser tear line extends to an edge of the top end flap that is spaced apart from the first side panel and the second side panel.

49. The method of claim 48, wherein the blank further comprises handle features comprising a handle panel extending in at least the dispenser panel.

50. The method of claim 48, wherein:

the end flaps comprise at least a top end flap foldably connected to the top panel, and a side end flap foldably connected to the first side panel;

the dispenser panel is separable from the opening section along at least a portion of the first portion of the dispenser tear line;

the opening section is foldably connected to the one of the first side panel and the second side panel along a fold line, the end tear line is a first end tear line, and the opening section is further defined by a second end tear line extending in the top end flap and a third end tear line extending in the side end flap from an end of the fold line;

the positioning the end flaps further comprising at least partially overlapping the second end tear line with the third end tear line.

51. The method of claim 50, wherein:

the first end tear line and the second end tear line at least partially define an end portion of the opening section in the top end flap, and the third end tear line forms an upper portion of the side end flap;

the positioning the end flaps further comprises at least partially overlapping the upper portion of the side end flap with the end portion of the opening section and adhering the end portion of the opening section to the upper portion of the side end flap.

52. The method of claim 48, wherein:

the end flaps comprise at least a bottom end flap foldably connected to the bottom panel and a side end flap foldably connected to one of the first side panel and the second side panel, the bottom end flap being connected to the side end flap by a gusset;

the positioning the end flaps further comprises at least partially overlapping the side end flap with the gusset and at least partially overlapping the gusset with the bottom end flap.

53. The method of claim 48, wherein:

the top panel is a first top panel, the dispenser panel is a first dispenser panel, the dispenser tear line is a first dispenser tear line, and the opening section is a first opening section, the first opening section being foldably connected to the first side panel along a first fold line;

the carton comprises a second top panel;

the dispenser further comprises a second dispenser panel and a second opening section, the second dispenser panel being at least partially defined by a second dispenser tear line extending in at least the second top panel, the second opening section is at least partially defined by the second dispenser tear line and is foldably connected to the second side panel along a second fold line; and the forming the interior of the carton further comprises at least partially overlapping the first top panel and the second top panel so that the second dispenser panel at least partially overlaps the first dispenser panel.

54. A method of opening a carton comprising:

obtaining a carton comprising a plurality of panels that extend at least partially around an interior of the carton, end flaps respectively foldably connected to respective panels of the plurality of panels, and a dispenser comprising a dispenser panel and an opening section, wherein the plurality of panels comprises a top panel, a first side panel, a second side panel, and a bottom panel, the end flaps comprise at least a top end flap foldably connected to the top panel, the end flaps are at least partially overlapped with respect to one another and thereby at least partially form a closed end of the carton, the dispenser panel is at least partially defined by a dispenser tear line comprising at least a first portion extending in at least the top panel and a second portion extending in the top end flap from an end of the first portion, the opening section is at least partially defined by the dispenser tear line in at least the top panel and an end tear line in the top end flap, the opening section being foldably connected to the first side panel, and the second portion of the dispenser tear line extends from the first end tear line in the top end flap away from the opening section so that the dispenser tear line is spaced apart from the first side panel by at least a portion of the opening section, wherein the second portion of the dispenser tear line extends to an edge of the top end flap that is spaced apart from the first side panel and the second side panel;

removing the dispenser panel to form a dispenser opening by tearing along the first portion and the second portion of the dispenser tear line in at least the top panel and the top end flap, respectively; and expanding the dispenser opening by tearing along at least the end tear line in the top end flap and pivoting the opening section relative to the first side panel.

55. The method of claim 54, wherein the carton further comprises a handle comprising a handle panel extending in at least the dispenser panel, the removing the dispenser panel comprising removing the handle panel.

56. The method of claim 54, wherein:

the end flaps comprise at least a side end flap foldably connected to the first side panel and a bottom end flap foldably connected to the bottom panel, the bottom end flap being connected to the side end flap by a gusset;

the gusset comprises a first gusset panel foldably connected to the bottom end flap and a second gusset panel foldably connected to the first gusset panel and the side end flap, and the second gusset panel at least partially overlaps and is adhered to the side end flap;

the expanding the dispenser opening further comprises folding the first gusset panel relative to the side end flap and the bottom end flap.

* * * * *